United States Patent [19]

Gardner Jr.

[11] Patent Number: 4,825,656

[45] Date of Patent: May 2, 1989

[54] ELECTROHYDRAULIC/AIR SCREW ENGINE

[76] Inventor: Elmer W. Gardner Jr., P.O. Box 39463, Cincinnati, Ohio 45239

[21] Appl. No.: 83,032

[22] Filed: Jul. 27, 1987

[51] Int. Cl.[4] ..... F01K 15/02; F01K 27/02

[52] U.S. Cl. ..... 60/668; 60/407; 60/698; 180/65.3; 180/65.4; 180/305; 180/310

[58] Field of Search ..... 60/407–412, 60/668, 669, 698; 180/65.3, 65.4, 302, 305, 307, 310

[56] References Cited

U.S. PATENT DOCUMENTS

| | | | |
|---|---|---|---|
| 139,997 | 6/1873 | Ball | 180/310 X |
| 381,160 | 4/1888 | Moon | 74/127 |
| 594,741 | 11/1897 | Harwood | 74/127 |
| 848,703 | 4/1907 | Taylor | 74/127 |
| 2,793,876 | 5/1951 | Allwes | 180/308 X |
| 4,413,698 | 11/1983 | Conrad et al. | 180/305 |
| 4,663,937 | 5/1987 | Cullin | 180/65.3 |
| 4,753,078 | 6/1988 | Gardner | 180/305 |
| 4,763,751 | 8/1988 | Gardner | 180/305 |

FOREIGN PATENT DOCUMENTS

| | | | |
|---|---|---|---|
| 64757 | 4/1913 | France | 74/127 |

*Primary Examiner*—Allen M. Ostrager

[57] ABSTRACT

A vehicle drive system in which batteries provide power for driving an electric motor connected to a pump for either compressing air or pressurizing hydraulic fluid for loading a fluid cylinder that is operatively connected for reciprocatably driving a series of drive gears operably connected to and for providing rotation to a series of worm screw gears having an output shaft connected for driving the wheels of a vehicle. A kinetic energy recovery system in which a series of gravitational alternators are operably connected between the axle and chassis/frame of a vehicle for providing electricity during vehicular movement. Additional kinetic energy is recovered as steam is generated by deriving heat from the operative fluid cylinder to the screw engine and transmitting the heated fluid to a low pressure steam boiler for providing steam in operating a screw engine generator for generating electricity.

5 Claims, 12 Drawing Sheets

ELECTROHYDRAULIC/AIR SCREW ENGINE

TECHNICAL FIELD

This invention relates to a regenerative vehicle drive system that is either pneumatically or hydraulically controlled and has electricity as its power source.

BACKGROUND OF THE PRIOR ART

A thorough search was conducted covering all aspects of previous vehicular drive systems as indicated in the previous U.S. Patent documents and no similar device was found as outlined in this patent application. Prior art has disclosed a number of vehicle drive systems using wind generators in combination with electric motor driven vehicles, quite a number of vehicle drive systems having gasoline engines for driving a generator or alternator for supplying electricity to an electric driven vehicle and also the opposite whereby an electric motor is the auxiliary power to a gasoline driven vehicle, a number of energy storage devices as flywheels in combination with the gasoline engine and also several hydraulically driven vehicles having electricity as the power source. Conrad U.S. Pat. No. 4,413,698 there is disclosed a hydraulically motor driven vehicle that is battery controlled, has a hydrostatic transmission and a hydraulically driven generator for the recharging of batteries. The Gilbert U.S. Pat. No. 3,948,047 relates to a turbine wheel of improved design having a hydraulic pump as a source of power that is driven by an electric motor or gasoline engine and the output of the pump is connected across a sequencing valve to a rotor or a power wheel unit. U.S. Pat. No. 3,379,008 shows the turbine having a vane rotor within its shaft connected to a transmission and responsive to compressed air to propel a vehicle. U.S. Pat. No. 2,468,828, Kopp, shows the use of a turbine type hydraulic motor in a vehicle drive system, U.S. Pat. No. 3,456,520 describes a hydraulic drive in which a hydraulic motor drives the vehicle and also serves as a pump during braking. U.S. Pat. No. 3,734,255 discloses an improvement in an hydrostatic drive system by the adjustment of the control means by regulating the pressure so that the hydraulic motor operates as a constant motor. The hydraulic motor drives have been driven either by an electric motor to a pump or by a gasoline engine and in several of the disclosures the hydraulic drive system serves as auxiliary power to the gasoline engine driven vehicle.

In the Spahn U.S. Pat. No. 3,556,239 discloses a battery powered vehicle having air operated turbines for providing charging current to batteries and for driving the vehicle. Horvat U.S. Pat. No. 4,002,218 discloses a series of flat rotary vanes operated by fluid currents that generate electricity through sensing switching controls to a storage battery for providing electricity to an electric motor for driving the vehicle. In U.S. Pat. No. 4,254,843, Han, discloses the application of a whirl ventilator system using air flow and vehicle momentum to a clutch mechanism at the drive shaft for driving an electrical generator in the recharging of batteries for supplying electricity for driving an electric motor to the vehicle and also an on-board fuel powered engine for driving an electrical generator. In the Horwinski U.S. Pat. No. 3,904,883 it is disclosed a hybrid energy converter and transmission unit wherein one and the same electrical machine is used as the drivng motor and also as the generator for recharging the batteries in an electrical driven vehicle. This required high starting currents. In U.S. Pat. No. 4,042,056 Horwinski also disclosed a hybrid vehicle power system involving both an electric motor and an internal combustion engine, wherein excessively and abnormally high starting currents are eliminated by using a simplified power transmission having an exceptionally high speed ratio and range, and one set of wheels is powered by the internal combustion engine and the other set of wheels is powered by an electric motor. The drive comprises a combination to a magnetic clutch with chain drive to the front and the rear to sets of cone pulleys connected by a chain drive to the motor. In U.S. Pat. No. 2,974,769 there is disclosed a vehicle transmission in which mechanical energy obtained from an internal combustion engine is connected through a magnetic particle clutch to a gear box which is coupled to the drive shaft of a vehicle. In U.S. Pat. No. 3,845,835 there is disclosed an electric power plant for a land vehicle which includes an electric motor, for turning the drive shaft of the vehicle, two alternators also driven by the motor, a voltage regulator for the alternators and two sets of batteries charged alternately through the regulator. The battery not being charged energizes the motor. The alternators are connected to the axles of the vehicle. In U.S. Pat. No. 3,077,121 shows an automatic transmission control system which includes a plurality of magnetic particle clutches. And other examples of transmission mechanisms employing magnetic partical clutches include U.S. Pat. Nos. 2,688,388 and 2,718,157. In U.S. Pat. No. 3,917,017 discloses a battery operated vehicle drive system in which two sets of series connected batteries are alternately charged by an internal combustion engine under control of a change over selector. The vehicle speed is controlled by selection of power terminals, at different voltage levels, from which the drive motor is energized. In U.S. Pat. No. 3,367,438 is described a power plant for a vehicle in which an internal combustion engine and an electric motor are used alternatively for powering the vehicle.

In U.S. Pat. No. 4,095,664, Bray, discloses an arrangement in which a constant speed AC motor is energized through an A.C. alternator which is driven primarily by a battery powered 12VDC motor which also drives three DC rectified alternators used for providing energy to recharge batteries and energize the magnetic clutch that is coupled to the output shaft of the AC motor, and a small gas motor is detachably connected to the alternators in parallel with the DC motor and operates only when power in the batteries becomes lower than a predetermined level. The vehicle is primarily powered by the electric motor AC to the particle clutch producing a variable speed to the drive shaft of the vehicle and in certain instances the vehicle is powered by the gasoline engine.

In U.S. Pat. No. 4,042,054 and 4,0422,055 Ward is disclosed means for providing a lighter frame requirements and reduced battery load and also a chain drive is associated with each drive wheel and the vehicle has a non rotating axle, is electrically driven by a DC electric motor and has a battery pack that can easily be removed from the vehicle.

In U.S. Pat. No. 3,575,250 Dykes is disclosed an electric driven vehicle with each wheel having its own motor that are series connected at one setting and parallel connected at another, and in turning, one of the motors will load and slow down and the other will speed up in a differential action.

In U.S. Pat. No. 3,190,387 Dow is disclosed a four wheeled vehicle having two drive wheels each provided with its own motor carried on the vehicle frame which is sprung up on the wheels.

In U.S. Pat. No. 3,878,913 Lionts is disclosed a weighted flywheel operatively connected to a fan and through reduction gearing to a generator shaft and to a freewheeling type of clutch overdrive for charging batteries for driving an electrically powered vehicle.

In U.S. Pat. No. 3,734,222 Bardwick IIi is disclosed an inertial energy flywheel system which includes clutch means for introducing energy to the flywheel from an engine or from a coasting or decelerating vehicle and clutch means for transferring the stored energy to the vehicle on demand.

In U.S. Pat. No. 3,882,950 Strohlein is disclosed a means for withdrawing surplus power from the primary source of power to a vehicle and storing it in a flywheel operatively connected to the drive train of a vehicle at selected times and to use this energy to drive the vehicle.

U.S. Pat. No. 2,941,613 and U.S. Pat. No. 3,444,946 shows having a clutch and flywheel governed transmission of generator driving power from a rotary fan with an intake air scoop and fan housing.

U.S. Pat. No. 3,621,929 Oberthur shows regenerative braking in which an electric motor operating as a generator to the rear axles of a vehicle with the hydraulic braking system not taking effect until the electric motor braking has reached its maximum value.

U.S. Pat. No. 4,277,737 Werth shows a method and means for utilizing rechargeable batteries in the operation of electric vehicles by recharging one or mre battery blocks, each consisting of several batteries, by generators driven by braking energy, solar-cell arrays, or a power supply drawing rectified and stabilized current from a utility network.

U.S. Pat. No. 4,348,628 Loucks shows an electric driven vehicle having an electric motor operated by two alternating power circuits, each having a battery with a circuit for an open and closed mode of operation that permits the electric motor to be operated by one battery while the other battery is being recharged.

U.S. Pat. No. 4,533,011 Heidemeyer and Zantopp shows a hybrid drive for an electric vehicle having an electric motor being connected with a driving axle of the vehicle by means of a first disconnecting clutch and with an internal combustion engine arranged in series therewith by means of a second disconneecting clutch wherein the internal combustion engine is designed without a flywheel and the flywheel mass required for its operation is an integral component of the rotating masses of the drive between the disconnection points of the two disconnecting clutches.

U.S. Pat. No. 4,227,587 Carman shows an automotive drive system in which an hydraulic pump is mechanically coupled to the wheels of a vehicle for pumping fluid under pressure to an accumulator for transmission to an hydraulic motor mechanically coupled to the engine for driving said engine, including speed responsive means for stopping the flow of hydraulic fluid from said accumulator to said motor when the engine has reached a predetermined speed.

U.S. Pat. No. 4,532,769 Vestermark shows an energy storing flywheel assembly comprising two hubs having first and second reels with the second hub being larger than the first with a coiled ribbon extending between the first and second hub and a clutch control mechanism for transmitting rotational power from a power input to a power output shaft.

U.S. Pat. No. 4,383,589 Fox shows a pneumatic vehicle drive system in which each wheel is provided with a motor driven by compressed air from a storage tank and the rotation of each wheel is also utilized for driving air compressors in compressing air for storage.

U.S. Pat. No. 4,163,367 Yeh shows a hybrid flywheel/compressed fluid propulsion system for vehicle drive comprising a compressed fluid powered turbine in conjunction with the use of a flywheel in which the turbine serves as a compressor expander for driving an output shaft and for recovering kinetic energy during braking and deceleration and the flywheel is used for recovering kinetic energy and for driving an output shaft and an AC alternator and the flywheel/motor/alternator unit can be driven by an A.C. motor transmitting shaft power to the expander/compressor.

U.S. Pat. No. 4,290,268 Lowther shows an auxiliary kinetic energy recovery system for a vehicle with a rotary sliding vane engine including a compressor, a combustion chamber and a motor in which the braking is done by connecting the rotor of the compressor to a wheel and braking rotation of the rotor by controlling the gas flow through the rotary sliding vane compressor.

U.S. Pat. No. 4,590,767 Gardner, Jr shows an auxiliary power drive system, including kinetic energy recovery, coupled to an internal combustion engine in which by passed exhaust gas is fed to a rotary vane for driving an output shaft and also for compressing air and an electrohydraulic motor as auxiliary power to the internal combustion engine, including the recovery of kinetic energy by the application of alternators, hydraulic pumps and compressors to the drive shaft and wheels of the vehicle.

The greatest problem experienced with the electric and hydraulic driven vehicle is the need for greater efficiency, for hydraulic motors and electric motors are most efficient at constant speed which presents considerable difficulty in a variable speed drive system as evidenced in vehicular drive. With the electric vehicle, high starting torque is necessary which requires a high starting current that causes a high internal voltage drop in batteries. Amperage hour capacity goes down drastically with high current draw and also the life of the battery. And as shown in the prior art, whether electric motors are adapted to the drive wheels or to the drive shaft, it is necessary to gear down the electric motor as it functions best at high RPM. Torque is difficult to control with the electric motor and also the hydraulic motor.

The electrohydraulic vehicle drive system offers an advantage and in U.S. Pat. No. 4,413,698 Conrad shows a method for providing a constant speed electric motor to a hydraulic drive system in which the fluid flow to the hydraulic motors is controlled by a system of valves which also control the speed of the vehicle. This has eliminated the need for a high starting torque to the electric motor and with a reduction in the overall size of the batteries needed, however, the hydraulic motors require a constant high pressure flow of fluid at all times in order to be operational and this causes inefficiency.

The prior art does not disclose one system that is efficient enough and has the provision for providing the total energy source for driving a vehicle over long range without the need for down time and the recharging of batteries or the need for an external supply of fuel in a manner similar to the gasoline or diesel engine.

For any vehicle to replace or serve as a substitute to the internal combustion engine, its efficiency must be at the maximum and with the capability for regenerating a high percentage if not all of the energy needed for driving the vehicle under all road conditions.

In the prior art U.S. Pat. No. 4,413,698 in which Inventor Conrad has succeeded in regenerating a high percentage of energy by the application of an electric motor connected to a pump for driving an alternator, however the hydarulic motor that drives the alternator lacks the efficiency needed for generating a high percentage of electricity.

The variable and exceedingly high energy demands for driving vehicles has not been met with a complete and comprehensive regenerative system and has fallen short of providing competitive performance characteristics of that experienced with the internal combustion engine; so no hybrid vehicular drive system has proven to be wholly suitable, adaptable and totally acceptable as an alternative power source for driving non-stationary vehicles, mainly because it relies too heavily upon external means for supplying the energy necessary for operating such a system.

TECHNICAL FIELD

This invention relates to either compressed air or fluid hydraulics under pressure for driving vehicles in which the basic energy is supplied by a series of storage batteries.

BRIEF SUMMARY OF THE INVENTION

This invention comprises an improved method for connecting an Electrohydraulic/Air screw Engine directly to the drive axles of a vehicle, either for four wheel drive or for single axle drive, in which the engine is positioned between the two wheels after removal of the differential and portions of the axle housing from the vehicle.

A standard air or hydraulic cylinder, having either a single or double rod, is arranged for driving one or several geared elements comprising a hardened steel metal plate with either a rectangular or square opening that is adjustable and arranged for acceptance therethrough the screw arrangement to a stationary worm screw gear that is rotated by the reciprocating movement and engagement of the rectangular or square gear, as driven by the piston and rod to the hydraulic or air cylinder.

The worm screw gear can have either the same pitch arrangement throughout its entire length, or the pitch can be variable with a right hand screw pitch at one end running to its center and therefrom to its end a left hand screw pitch. With the double pitch arrangement for the one screw gear, the screw gear will rotate in one continuous direction regardless of which direction the piston and rod is being reciprocated in driving the drive gear to the worm screw gear. However, when the arrangement is one screw pitch throughout the entire length of the worm screw gear, the screw gear will rotate only either to the push or pull movement of the piston rod but not to both.

Installing two worm screw gears each having a different direction of drive pitch and the engaging drive gear making connection in one direction of reciprocation only, with the other drive gear being in the release mode, and vice versa, permits both worm screw gears to be rotated either to the push or pull movement of the piston rod thereby giving one continuous rotating force to the output shaft which would be to the axles of the vehicle for driving its wheels. This method is most applicable to a single rod cylinder, whereas using a double rod cylinder permits continuous rotation to the screw gear either in the pull or push movement using a variable pitch screw gear arrangement.

Each end of the screw gear is adapted to a bearing fixed to a stationary mount, and the rotatable shaft at each end of the screw gear is arranged for driving either a pulley and belt or a splined or spur, spiral, mitre, helical, bevel or a common gear arrangement as would be evidenced in a standard vehicle transmission. Using the belt and pulley arrangement, the output shaft would be adapted to a variable pulley that would permit differential action at the wheels while going around curves. With the gear arrangement, the differential action would be effected either by a slip clutch arrangement to the gear and shaft or a rack and pinion arrangement to each axle output shaft.

The screw gears and operative elements and the hydraulic or air cylinder and the valves are encased inside an engine housing, and this could also include the hydraulic pump and electric motor. The complete unit would be positioned underneath the chassis of the vehicle and between the wheels. This confined arrangement reduces weight and also confines the operative elements to a central location, and even the storage batteries could be confined inside the engine housing with certain types of vehicles and with others the batteries would be in a separate position and to the chassis. By having the engine weight centered to gravity and low to the vehicle at the axle and not the chassis, more stability is provided to the vehicle and also with the allowance for an increase in load weight to the chassis.

The advantage of this invention to other hybrid type drive systems for vehicles is the application of the screw gear driven by either compressed air or pressurized hydraulic fluid to a definite bore size cylinder permits measurable control of energy that is to be consumed with a high degree of efficiency and with no wasted motion. This is due to the fact that no energy is used when the vehicle is not in motion and the energy used is controlled in proportion to its speed and weight, as the top speed of the vehicle and the energy needed to drive it under specific load requirements can be predetermined and the pressure and volume of working fluid fed to the cylinder is accurately controlled for each vehicle speed.

The screw gear can give considerably more output revolutions per foot of distance traveled by the reciprocatable piston in the cylinder in comparison to any other type of rotary application, including the various gears of the rotary type that can be measured by its diameter and number of teeth, and also including the crank and shaft arrangement to a piston, as with the internal combustion engine.

Using the screw drive engine allows for the application to heavy equipment such as buses as used in public transportation and also large truck vehicles as with tractor trailers because the hydraulic cylinder can provide considerable torque and power, as is evidenced by its many years of application in industry and with heavy construction equipment, whereas the screw gear can provide the speed for driving the output shaft that is necessary for high speed driving and under various load conditions. Of course, the larger the cylinder bore the less initial fluid pressure but the greater the volume of fluid, and volume flow is needed for high cylinder velocity. However, at lower speeds very little volume flow is needed that allows for fluid accumulation for later application, it being stored temporarily in accumulators for later application, and during periods of operation the vehicle can be driven by accumulative fluid alone allowing for the accumulation of electrical energy in storage batteries.

For large size vehicles or vehicles requiring extreme high speed application, a series of cylinders can be arranged to a series of different size screw gears, and the cylinders can vary in bore size accordingly, and a series of valves can control the flow of fluid to the different drive cylinders according to demand. Where great power is required, a large size bore cylinder could be used, as on startup, and when a certain speed is attained (cylinder velocity or vehicle speed), fluid control could be switched to a smaller diameter bore cylinder with a corresponding screw gear that would reduce the volume of working fluid required with some increase in pressure. It is found that vehicles traveling at a constant speed between 40 to 60 miles per hour would be adaptable to this arrangement to a 1½ to 2" bore cylinder for maintaining this speed with considerable conservation of energy, High starting torque is not required for the electric motor, that can be either AC or DC, and that operates a hydraulic pump for loading the cylinder, as startup is under a no load condition. The only load on the electric motor is the hydraulic system. And the main problem with hydraulically driven vehicles, whether gas or battery driven, is that the system must be continually operating in the full position to maintain a constant pressure of hydraulic fluid at full speed, even during idle periods. This is not necessary with this hydraulic system.

Applying the screw drive to the air or hydraulic cylinder allows for limiting the size of the driving motor to reduce current drain without sacrificing or limiting the speed of the vehicle. And accumulated fluid can be used for vehicle startup and for driving the vehicle. No electric controller is needed, which is added weight, cost and requires considerable maintenance. This invention is very economical to manufacture, as there are few moving parts, and very little maintenance would be required with the exception of battery replacement upon expiration. No previous method has yet beed devised that would provide for driving large type vehicles, such as transportation buses and tractor trailer vehicles at highway speeds that is required for highway travel. And the greatest expenditure of energy is in the industrial and commercial sector of the economy. The greatest need for pollution control from ICE emissions and for the saving of energy is with the large size vehicle as described above. This invention does have the capability for solving this problem in that hydraulic cylinders, accumulators, boosters, pumps and electric motors have been used successfully on a practical basis in industry for many years, and by applying the screw gear as a positive drive to this invention, it can be shown that this invention is suitable for driving almost any type of vehicle in a safe, economical and practical manner.

With all electrical driven vehicles, such as this described herein, the time between battery charging is extended but not eliminated and the batteries must be externally recharged periodically. Better and higher capacity batteries are expensive and offer no economical advantage in comparison to the internal combustion engine. With this invention the batteries can be under constant charge by on-board charging devices that with most vehicles and, depending upon the driving conditions and the speed of the vehicle, no stationary recharging should be necessary.

The preferred embodiment for this invention is for the application of at least two separate battery packs in which one battery pack would be connected to the electric drive motor and to the second battery pack that would be connected to a charging source and with smaller size vehicles the battery packs would be either 36 volts or 72 volts direct current. With the larger size vehicles, several battery packs could be connected in series having high voltage that would reduce high amperage. Using a multistage pump having the capacity for high pressure and low volume, high volume and low pressure and high pressure and high volume is preferred, although any pump combination can be used as a second or third backup pump for selectively serving as a transmission controller for different speeds in the large size vehicle and for conserving energy. A flow control valve serves as a speed controller that controls the flow of working fluid to the cylinder.

The most difficult problem with electric driven vehicles is the limited operating range, even with high capacity batteries, that require down time for the recharging of batteries, and there is no known electric drive system where the recharging of batteries is eliminated completely. This has been moreso due to the high energy requirements for driving an electric vehicle and the lack of provision for the recharging of batteries while the vehicle is in motion. Also, with the systems now currently available there is considerable wasted energy due to considerable inefficiency. With this invention provision is made for constant recharging of the battery packs during vehicular movement.

By having at least one alternator positioned between the axle and the frame/chassis of a vehicle, that is operated by the vehicular movement, and connecting the alternator to a battery source, electricity is constantly being generated while the vehicle is in motion. The alternator rotor is driven by the extension at each end of the rotor shaft forming a screw gear having a right hand pitch on one end and a left hand pitch on the other end, the alternator being stationary to the vehicle frame or chassis and one drive gear connected to the screw gear at the axle and the second screw gear connected to a drive gear at the chassis/frame of the vehicle.

Having an alternator connected in this manner to each of the four wheel wells and each axle of the vehicle provides for a constant recharging at the battery source and, depending upon the terrain, road conditions as to vehicular movement and speed of the vehicle, it is possible under certain conditions to recharge the battery source at the same rate of discharge. Of course, this is taking into consideration the regenerative capabilities of the vehicle during braking and deceleration whereby the electric motor serves as a generator and auxiliary alternators connected to the output shaft of the Electrohydraulic/Air screw engine also generate electricity for storage. This would be under conditions whereby there would be constant, continuous and heavy vehicular movement, as would be experienced in traveling a road having an irregular surface that would impend upon the full application of the vehicle suspension system. As most vehicles have shock absorbers for the purpose of control and absorbing body movement, as evidenced on a bumpy road, this screw drive alternator could replace the shock absorber element and serve the same function.

This would also permit the application of a 90 ampere or higher alternator for medium size vehicles, as the energy needed for generating electricity would be used in driving the screw gear which should have the maximum screw pitch allowable that would not only give high revolutions per minute, even at low shaft speed, but would require force for turning the rotor, causing a stabilizing action between the axle and frame elements to the vehicle. The turning force exerted to the screw gear would be the weight of one fourth of the vehicle to its gravitational force at the moment of force, less any absorption by a spring element. The rotational force as applied to the rotor and stator would generate a steady current for transmission to the storage batteries.

As disclosed in patent application No. 850,996, Electrohydraulic Vehicle Drive System, and Nos. 880,547 and 945,006 and 027,838, application is made to the axle and chassis of a vehicle for driving an alternator and a hydraulic pump/accumulator for recoverying kinetic energy. Also, in application 850,996 it is disclosed the use of a steam generator and solar energy for generating electricity. For large vehicles such as trucks and buses, the use of a steam generator for driving an air/hydraulic screw engine connected to an alternator and a battery source would be feasible, especially for over the road travel. Additionally, it is disclosed the use of a wind generator and a gyrogenerator for generating electricity during vehicular movement. The hydraulic pump/accumulator that is positioned between the axle and chassis/frame to a vehicle would replace the shock absorber and would supply pressurized fluid for driving an Electrohydraulic Screw Engine connected operatively to an alternator for generating electricity.

OBJECTS OF THE INVENTION ARE:

(1) To provide for a highly efficient engine that is capable of driving any size vehicle (2) To provide for an on-board energy efficient regenerative system that will provide a high percentage of energy for driving the vehicle without depending completely upon fossil fuel as a source of energy and without requiring down time for the recharging of batteries

DETAILED DESCRIPTION OF THE INVENTION

Figure 1:
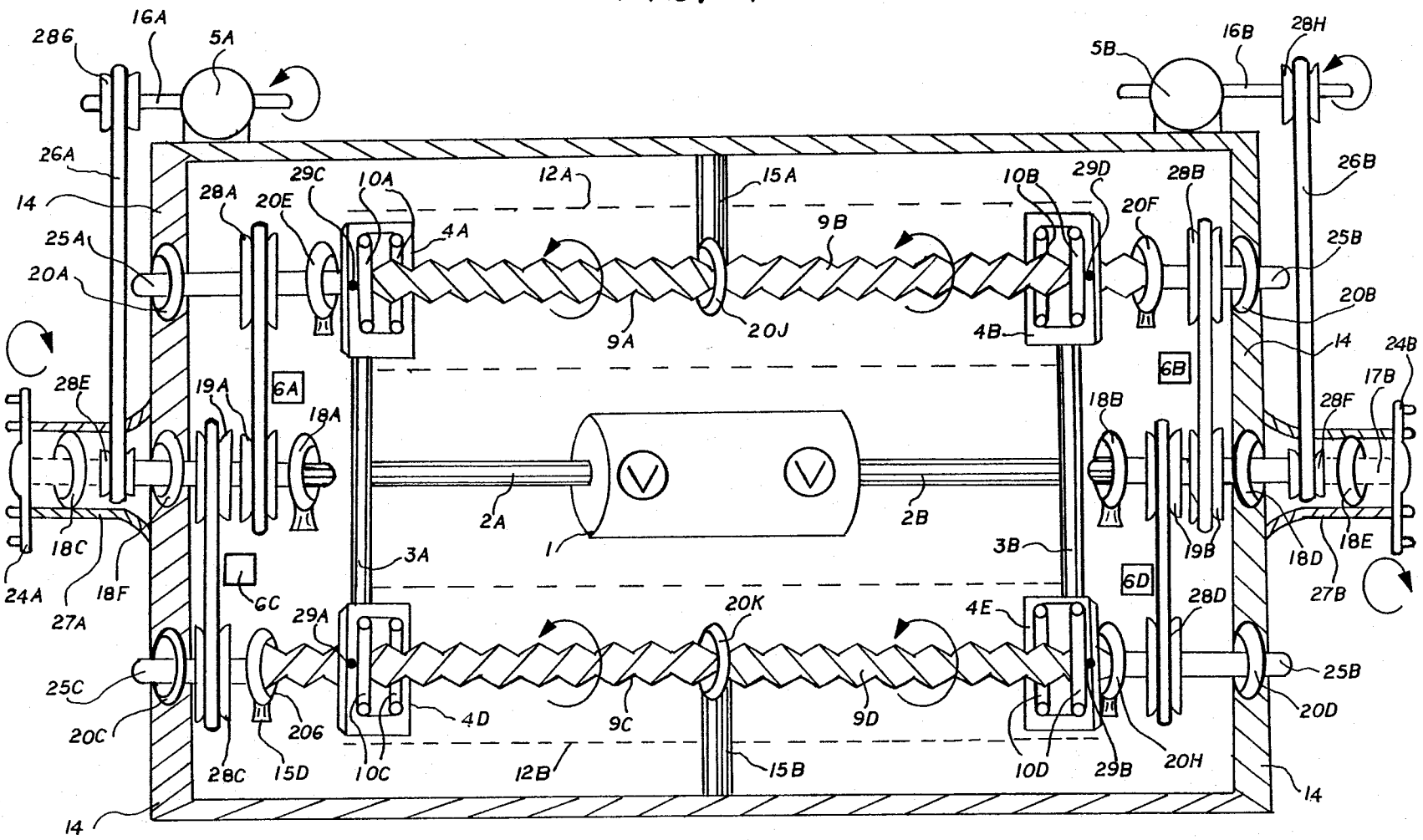
FIG. 1 is an illustration of the screw engine showing an arrangement in which a pair of multiple screw pitch gears are arranged to be driven rotatably by roller bearing rectangular gears reciprocatably connected to either an air or hydraulic cylinder, each end of the screw gear having an output shaft having pulleys and belts connected to variable pulleys connected to and for driving the axles of a vehicle, additionally a pulley is connected to each axle with a belt connection to a second pulley for driving an alternator.
Figure 2:
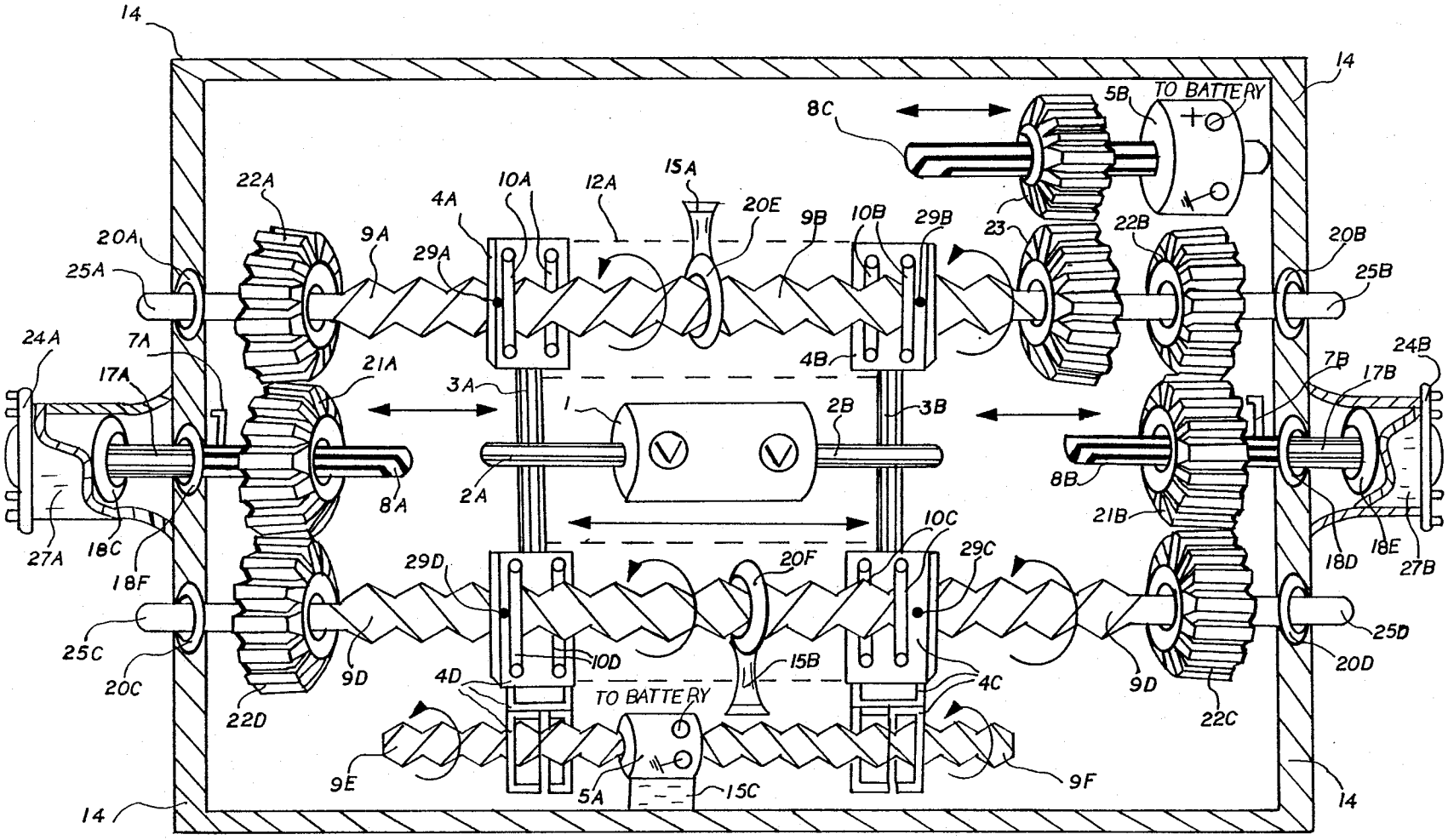
FIG. 2 illustrates a screw engine with the same screw gear arrangement as for FIG. 1, however drive gears and not pulleys are connected to the output shaft at each end of the screw gear and are arranged for driving a gear slidably arranged to each axle of a vehicle, and the arrangement inside the engine casing for a screw drive alternator to be driven by the air or hydraulic cylinder and a second alternator having a gear to its shaft rotor connected to a second gear driven by the output shaft of one of the pair of main screw gears.
Figure 7:
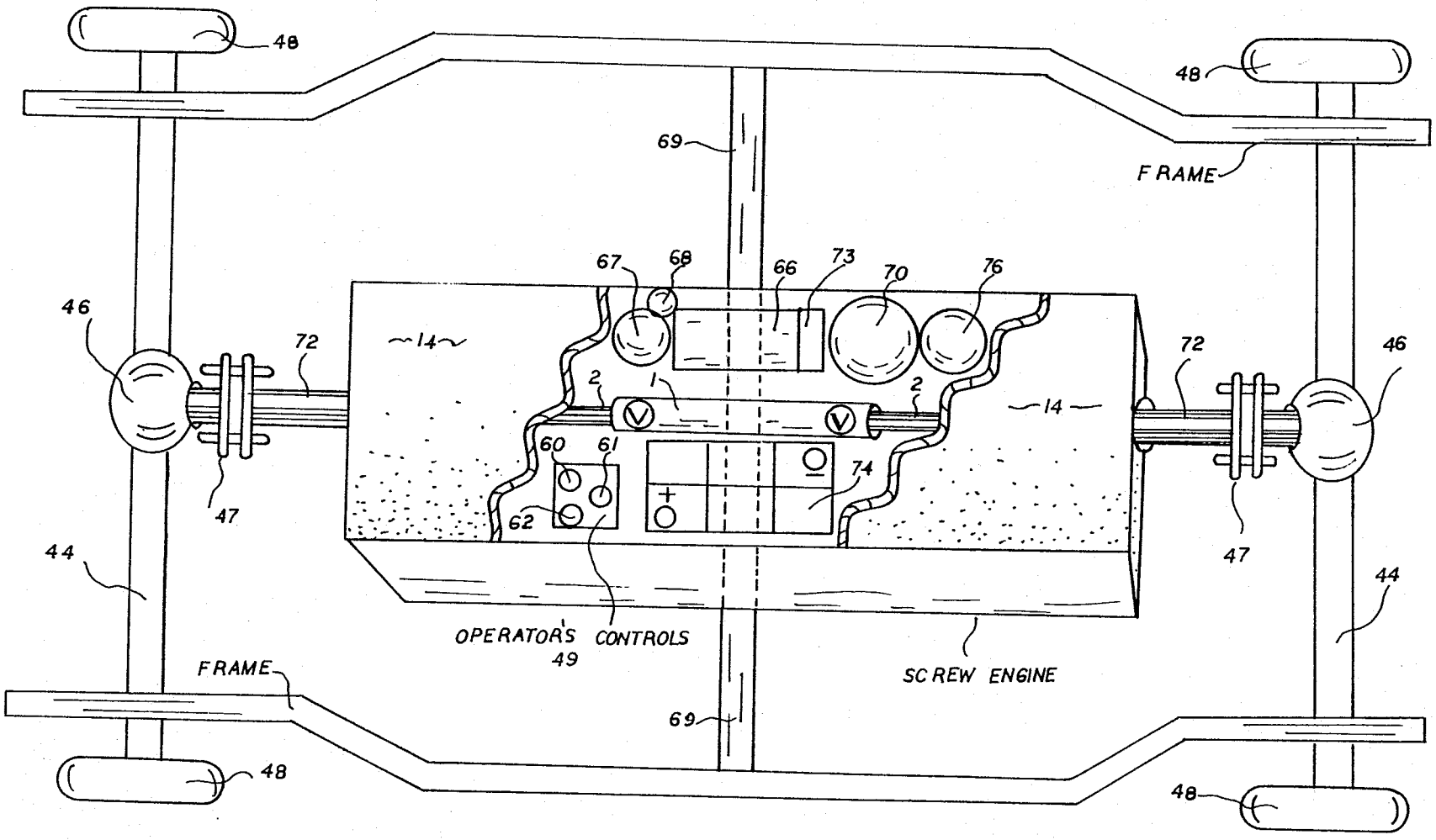
FIG. 7 is illustrative of a four wheel drive vehicle in which the differentials are 1:1 ratio or higher and having the screw engine connected therebetween.

The screw engine, as shown in FIG. 1, FIG. 2, FIG. 5, and FIG. 7 is enclosed in a housing 14 (not shown in FIG. 5) that also can contain auxiliary equipment as shown in FIG. 2 having an alternator 5A and alternator 5B, both operatively connected to the screw engine as shown in FIG. 7 and also the battery pack 71, the electric motor 70, the hydraulic pump 73, the storage tank 66, the booster 67 for increasing the fluid pressure, the switching controls 61 for operating a series of valves to the air or hydraulic cylinder 1 and the operator's controls 49, including the electric master control switch 62 for operator control for on and off switching to the electric motor 70, the accelerator control valve 61 that is a flow control valve positioned between the hydraulic pump 73 and the booster 67 and the valves to the cylinder 1 for minutely controlling the flow of working fluid to the cylinder 1. An accumulator 68 is positioned between the tank 66 and pump 73 for accumulating excess pressurized fluid from the pump 73 and a preset and predetermined pressure and volume flow valve is positioned at the inlet and the outlet to the accumulator 68 that automatically accepts and accumulates excess working fluid according to the volume of working fluid needed at the cylinder 1 and stores the fluid until the volume flow at the pump 73 is inadequate to meet the needs at the cylinder 1.

Illustrative to FIG. 1 and FIG. 2, wherein FIG. 1 shows a screw engine operative to pulleys and belts 28A, 28B, 28C, 28D connected to each end of the screw gear shaft 9A, 9B, 9C and 9D and the belts connected to variable pulleys 19A and 19B that are fixed to the main drive axles 17A and 17B that are connected to the wheel hub 24A and 24B for driving the wheels of a vehicle.

However, illustrative to FIG. 2 are a series of rotatable gears 22A, 22B, 22C and 22D that are connected to each end of the screw gear 9A, 9B 9C and 9D and the output shaft 25A and 25B, 25C and 25D are splined, as for the free movement of a second gear 23A that is connected to a third gear 23B that is slibably adaptable to a splined shaft 8C means a shift lever 7C and that serves as the rotor to an alternator 5B for generating electricity. Both screw engines as illustrated in FIG. 1 and FIG. 2 are adapted for generating electricity that is fed to storage batteries 71 as illustrated in FIG. 7. Also, in FIG. 2, a mechanical shift lever 7A and 7B is slidably connected to the axle 17A and 17B for operator control to the gear elements and for disengaging drive gears 21A and 21B by sliding the gears on the splined shaft 8A and 8B.

Figure 5:
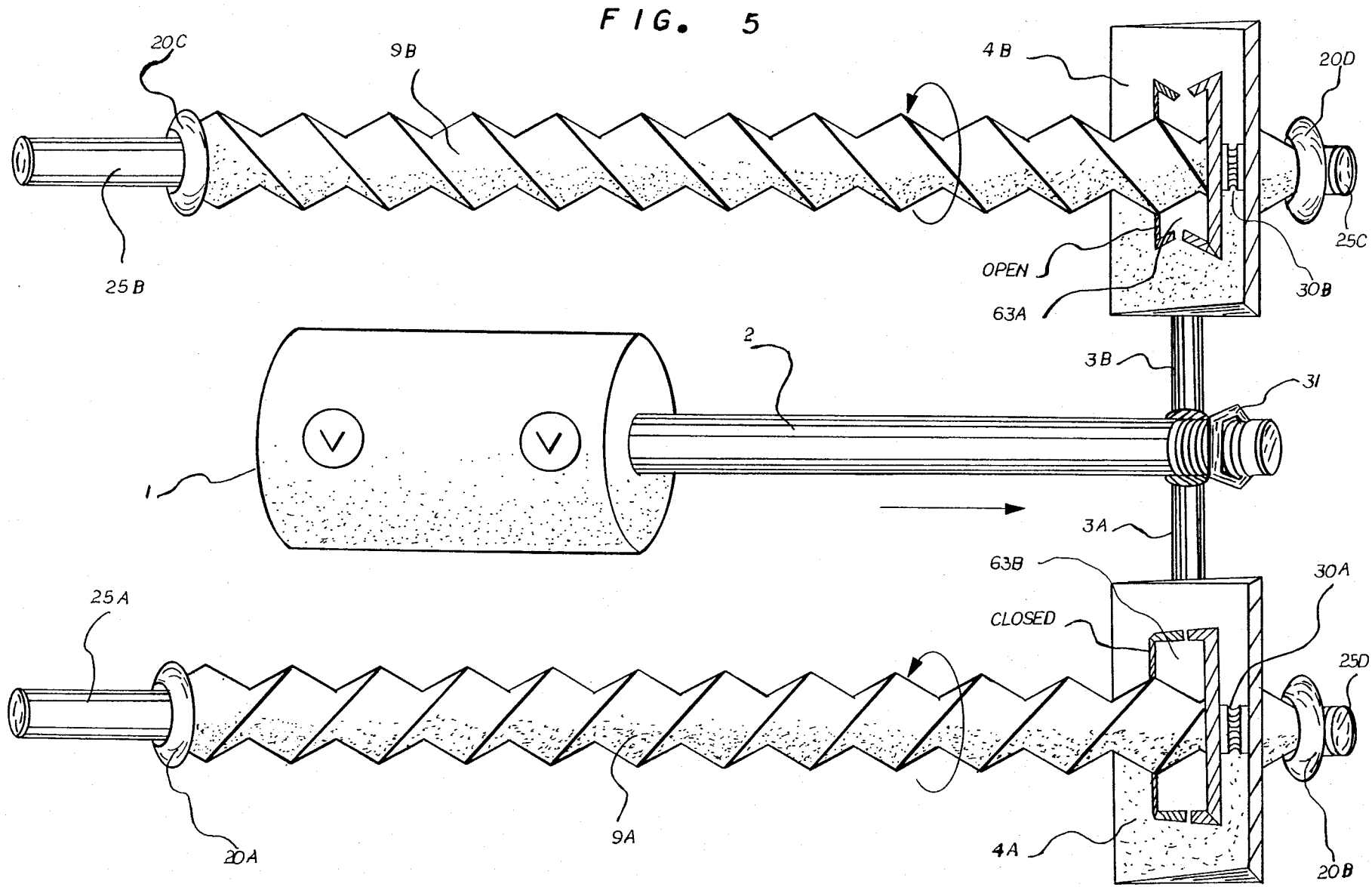
FIG. 5 shows two screw gears each having a single direction of screw pitch throughout its entire length arranged to be rotated by the reciprocatable engagement of a simple hinged drive plate adapted for engagement to one direction of reciprocation of the piston rod to the air or hydraulic cylinder and for disengagement in the other direction, either to its push or its pull.

As shown in FIG. 1, FIG. 2 and FIG. 5, the screw gear engine is a simple arrangement having few moving parts. Bearings are required to support the shafts, and bearings 20A, 20B, 20C and 20D are positioned at each end of shafts 25A, 25B, 25C and 25D that are a part of screw gear 9A, 9B as shown in FIG. 5 and 9A, 9B, 9C and 9D as shown in FIG. 1 and FIG. 2. Additionally, it is very important that these bearings are positioned to the housing 14, as shown in FIG. 1 and FIG. 2 and bearings 18D and 18F for the splined end of the axle shaft 17A and 17B that also are mounted to a bearing 18E and 18C that are adapted inside the axle housing 27A and 27B, as with a standard axle housing for a vehicle.

The simple arrangement for providing rotating force to the screw gears is by having at least two rectangular or square gears comprising as shown in FIG. 1, FIG. 2 and FIG. 5, a metal plate having a rectangular or square opening, preferably to its center, that can pass over and against the screw pitch to the screw gear 9A, 9B, 9C, and 9D, as it is reciprocated by the loaded piston (not shown) in a cylinder 1. As shown in FIG. 1 and FIG. 2 the drive plates 4A, 4B, 4C and 4D are connected to a control arm 3A and 3B that is connected to the piston rod 2A and 2B of a double rod cylinder 1. In FIG. 1 and FIG. 2 the screw gears have a multiple pitch, that is, one end has a right hand pitch and the other end has a left hand pitch, making it possible for the screw gears 9A, 9B, 9C and 9D to have one direction of rotation regardless of which direction the piston rod 2A and 2B is pushing or pulling. As a cylinder can exert more pounds of force during a push than a pull operation, the gears reciprocatable to the screw gears should be arranged so that the push force is the driving element to the screw. There are several methods illustrated for the arrangement of the drive gear, and they are shown in FIG. 3, FIG. 4, FIG. 5, FIG. 8, FIG. 9 and FIG. 10.

Figure 8:
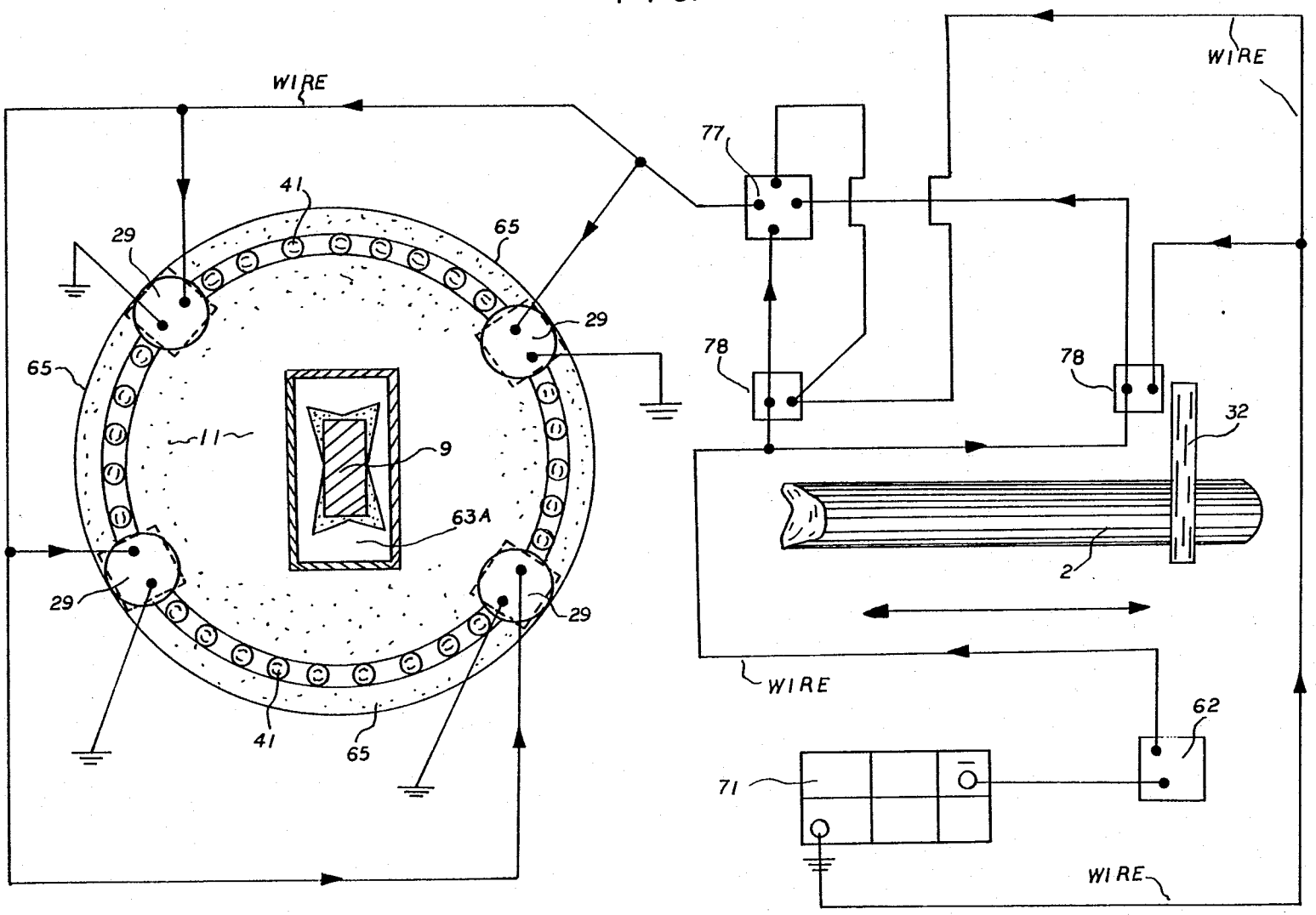
FIG. 8 is an illustration of the arrangement for engaging and disengaging the drive plate comprising the rectangular gear for driving the screw gear whereby the plate comprises two sections separated by a series of bearings and each section magnetically connected to a series of electromagnet switches that are energized by a battery pack according to the movement of a piston rod providing an electromagnetic clutch action to the drive plate.

FIG. 1 and FIG. 2, show a pair of roller bearings 10A, 10B, 10C and 10D adjustably adapted to the drive plates 4A, 4B, 4C and 4D that are operated for engagement and disengagement electromagnetically as illustrative to FIG. 8 wherein a trip switch 78 connected to a battery 71 source through wiring to a master switch 62 that is operator controlled and that is operative to a cam 32 positioned at the open end of the piston rod 2. Electricity is fed to a relay 77 for switching to a series of electromagnets 29 that are positioned to the race 65 and drive plate 11 comprising a rectangular gear 63A for engagement of a screw gear 9. A series of bearings 41 are in circumference between the drive plate 11 and the race 65 for free movement of the drive plate 11 to the race 65 when the electromagnets 29 are not energized. The race 65 is fixed to a control arm (not shown in FIG. 8) that is connected to the piston rod 2 for reciprocatably driving the race 65 and drive plate 11 that in turn rotate the screw gear 9 when the electromagnets 29 are energized.

Figure 3:
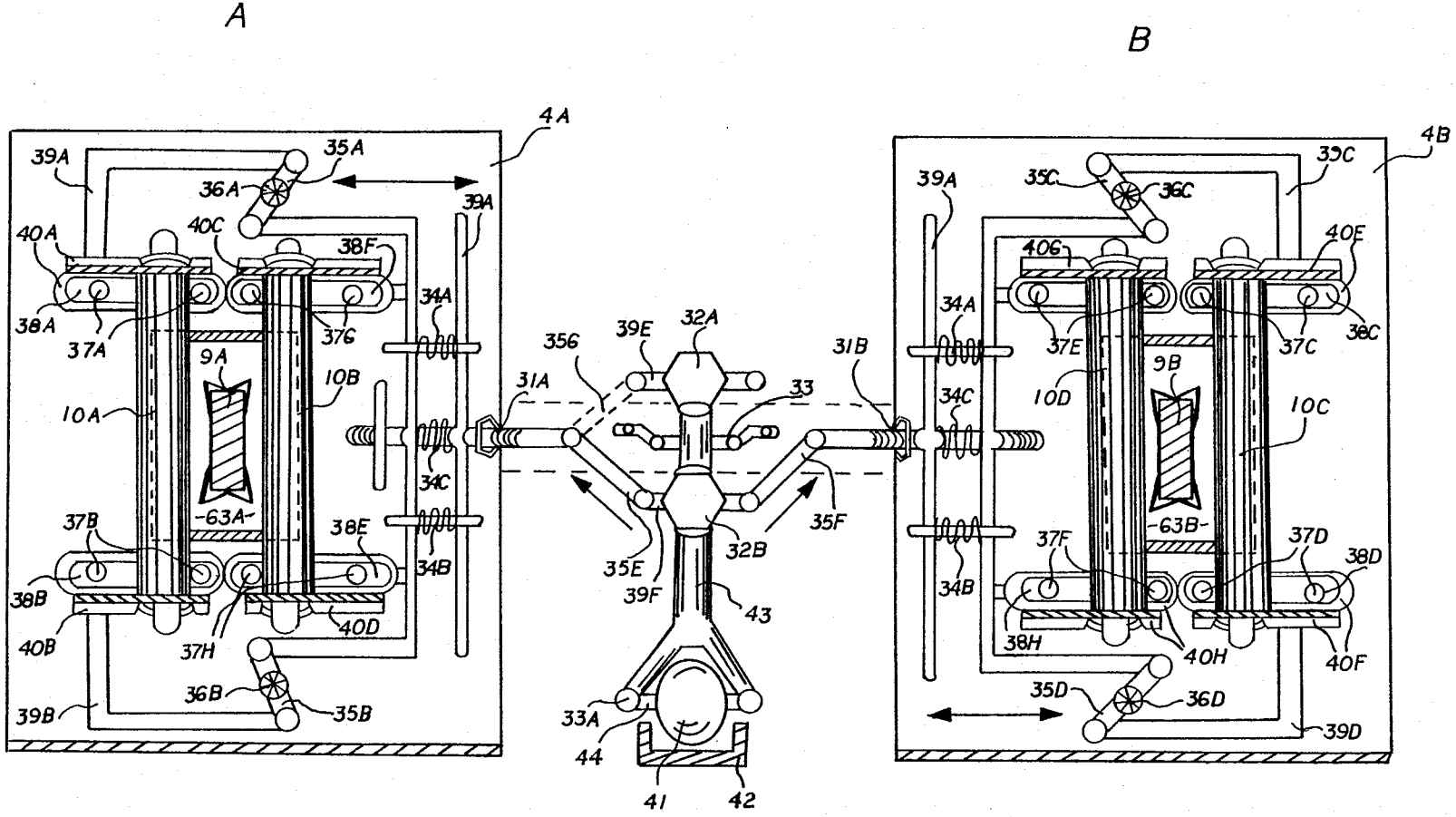
FIG. 3 is illustrative of the arrangement for mechanically engaging and disengaging the adjustable roller bearings that comprise the size of the opening for the rectangular or square gear through which the screw gear reciprocates.

As shown in the drawing for FIG. 3, a mechanical method for selective engagement and disengagement of the roller bearings 10A, 10B, 10C and 10D is an arrangement whereby the bearings are mounted to a stationary mount 40A, 40B, on one end as shown in FIG. 3A and to the other end mounts 40C and 40D, and as shown in FIG. 3B mounts 40E and 40G on one end of the bearings and mounts 40F and 40H to the other end. Each mount having an open slot 38A, 38B, 38C and 38D, 38E, 38F, 38G and 38H through which a mounting bolt or stud 37A, 37B, 37C, 37D, 37E, 37F, 37G and 37H are fixed to the drive plates 4A and 4B and are adjustable to slide in the slots for engagement and disengagement of the roller bearings 10A, 10B, 10C and 10D that form a rectangular arrangement 63A and 63B to the screw gear 9A and 9B. The operative arrangement is a pressure release mechanism in which a series of springs 34A, 34B, 34C connected between control arms 39A, 39B, 39C and 39D the spring tension being adjustable by a lock nut 31A and 31B that is connected to a lever 35E and 35F having a swivel joint serving as a crank arm to the springs as movement is applied to a cam, either 32A or 32B comprising a cam shaped lobe or locking or interlocking to control arm 3 as shown by the dotted line and that is connected to a piston rod (not shown).

FIG. 3 (A and B), the mechanical arrangement is for the piston rod to reciprocate the control arm 3, the control arm 3 having a swivel and lever 33 connected to it, the swivel and lever 33 connected firmly to a stem 43 having bearings 33A connected to an axle 44 having a wheel 41 to its center that rides slidably in a guide rail 42 to the movement of the control arm 3. The forward force of a push movement of the control arm 3 will force cam 32A forward and cam 32B in a backward movement thereby exerting force to either crank arm 35G (second one not shown) and the matching pair of crank arms 35E and 35F that is transmitted to the springs for either an opening or closing movement to the roller bearings 10A, 10B, 10C and 10D by the force exerted to crank arms 35A, 35B, 35C and 35D to a pivot bolt 36A, 36B, 36C and 36D that drives lever 39A, 39B, 39C and 39D in moving the mounts 40A, 40B, 40C, 40D, 40E, 40F, 40G and 40H in the slots 38A, 38B, 38C 38D, 38E, 38F, 38G, 38H. The preferred embodiment is for the roller bearings to be in the release mode during a pull operation and the engagement mode when the piston is pushing the rod (not shown) to the control arm 3.

Figure 4A:
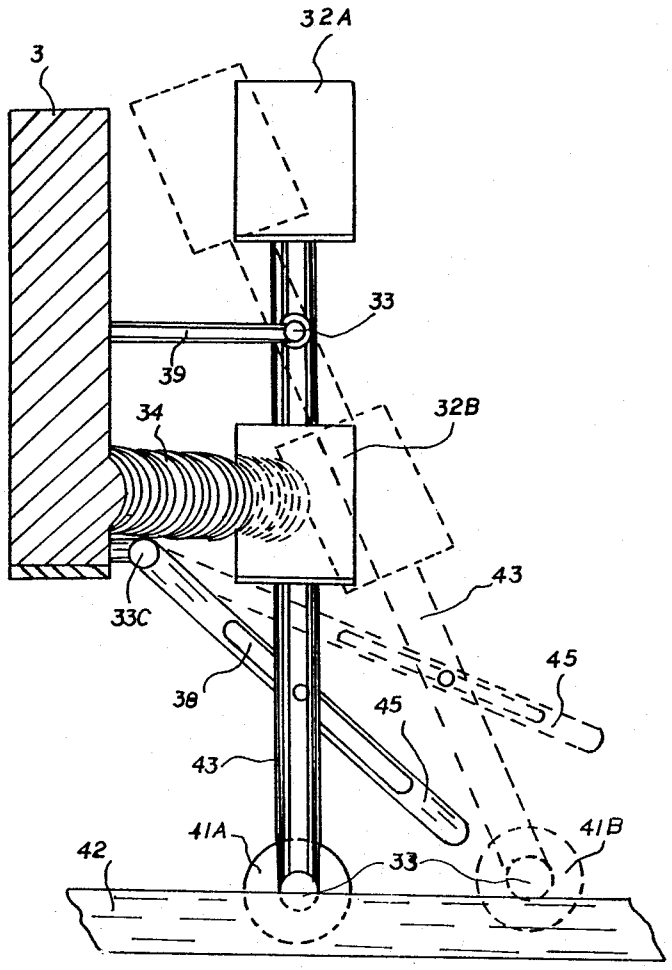
FIG. 4 illustrates in FIG. 4 B, the adjustable arrangement for the drive plate engagement to the screw gear and FIG. 4 A is illustrative of the mechanical arrangement for operatively connecting the roller bearings or the drive plate as illustrative in FIG. 3 and FIG. 4 B to the movement of the hydraulic or air cylinder.

FIG. 4A is a side drawing of FIG. 3 showing a forward movement of the control arm 3 with the control spring 34 during its extension and the control spring provides enough pressure that in the pull mode the stem 43 is retracted by means in the slot 38 to arm 45, upon movement of the control arm 3.

Figure 4B:
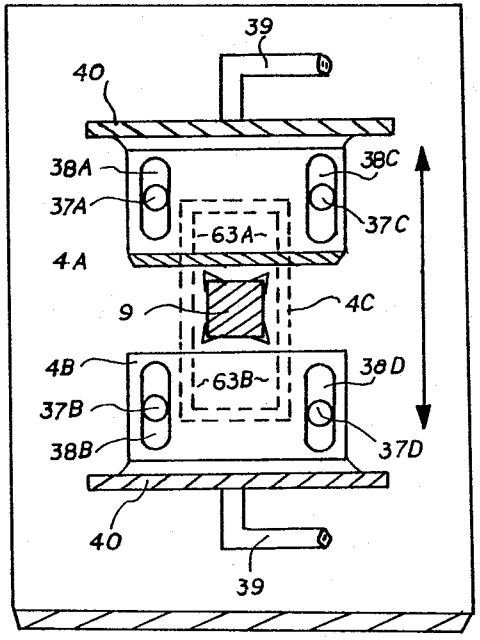

As shown in FIG. 3, FIG. 4B has the same mechanical application the drawing numbers being correspondingly the same for each operative element, however, in the place of roller bearings making contact to the screw gear 9, the drive plate elements 4A and 4B are adjustable to the entire drive plate element 4C that form the opening for the rectangular gear 63A section and 63B section for passage therethrough of the screw gear 9.

Figure 9:
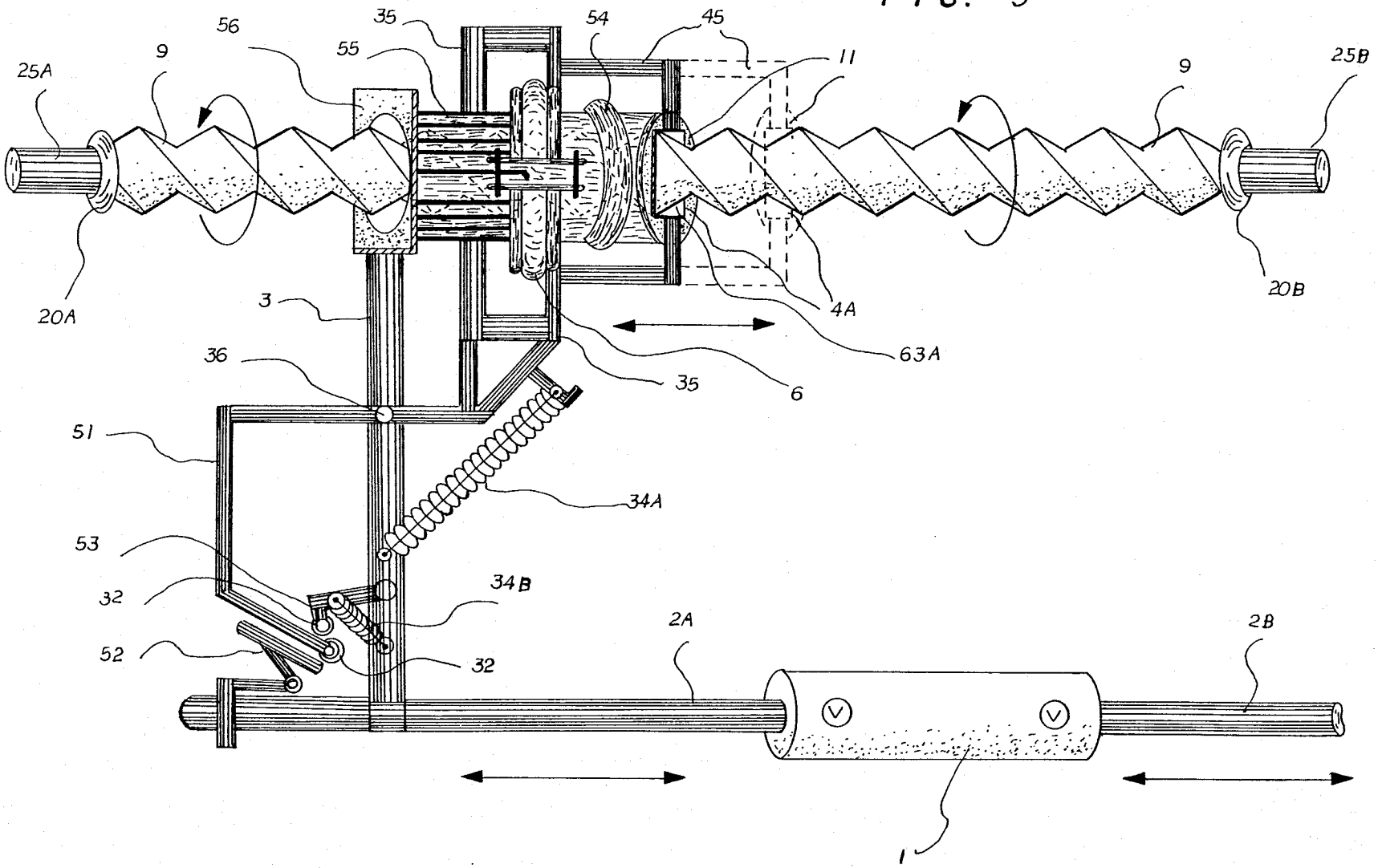
FIG. 9 is an illustration of a method for selectively engaging and disengaging the rectangular gear to the screw gear by having the rectangular gear slidably connected at one end of a hollow shaft through which the screw gear rotates and the shaft having a mechanical clutch mechanism for slidable engagement/disengagement to a throwout bearing, part of the clutch being connected to a lever operatively connected to the piston rod and to the rectangular gear and the other section fixed to the shaft.

Drawing for FIG. 9 shows a method for engagement-/disengagement of the rectangular gear 63A and drive plate 4A to the screw gear 9 whereby the drive plate 4A is fixed to a guide arm 45 connected to a crank arm 35 that is fixed to one side of a clutch mechanism, 6, the other side of the clutch mechanism 6 is adapted to a splined hollow shaft 55 having a backing plate 56 connected to the control arm 3 that is connected to a piston rod 2A.

FIG. 9, a clutch lever 51 that serves as a lever for slidably moving the crank arm 35 either in forward or reverse for overriding and releasing the outer part of the clutch mechanism 6 to a throwout bearing 54 for selective disengagement of the rectangular gear 63A from making contact to the screw gear 9. The preferred embodiment is for the clutch mechanism 6 to be in the release mode during a pull operation to the screw gear 9, as shown having an output shaft 25A and 25B at each end and also a bearing 20A and 20B that are connected to stationary mounts (not shown). The method shown herein for release is spring 34A that is connected at one end to crank arm 35 and the other end to control arm 3, a pivot bolt 36 that is adapted to crank arm 35 is also connected to control arm 3 and the spring 34A tension pulls the clutch mechanism 6 to the throwout bearing 54 for release thereoff of the clutch mechanism from engagement and for free movement thereof.

FIG. 9, However the clutch lever 51, that forms a part of the crank arm 35 has a cam at its open end that rides freely between a pressure trip mechanism 52 that is connected to the end of piston rod 2A and 2B that form a double rod cylinder 1. To the other side of the freely riding clutch lever 51 is a locking cam 53 that is spring loaded 34B and comprises a cam 32 to its open end for locked engagement to the cam 32 at the clutch lever 51 when the piston rod 2A or 2B is in the push mode for engaging the clutch mechanism 6 to clutch and shaft 55 and also for locking the drive plate 4A and the engagement of the rectangular gear 63A for rotating the screw gear 9.

Figure 10:
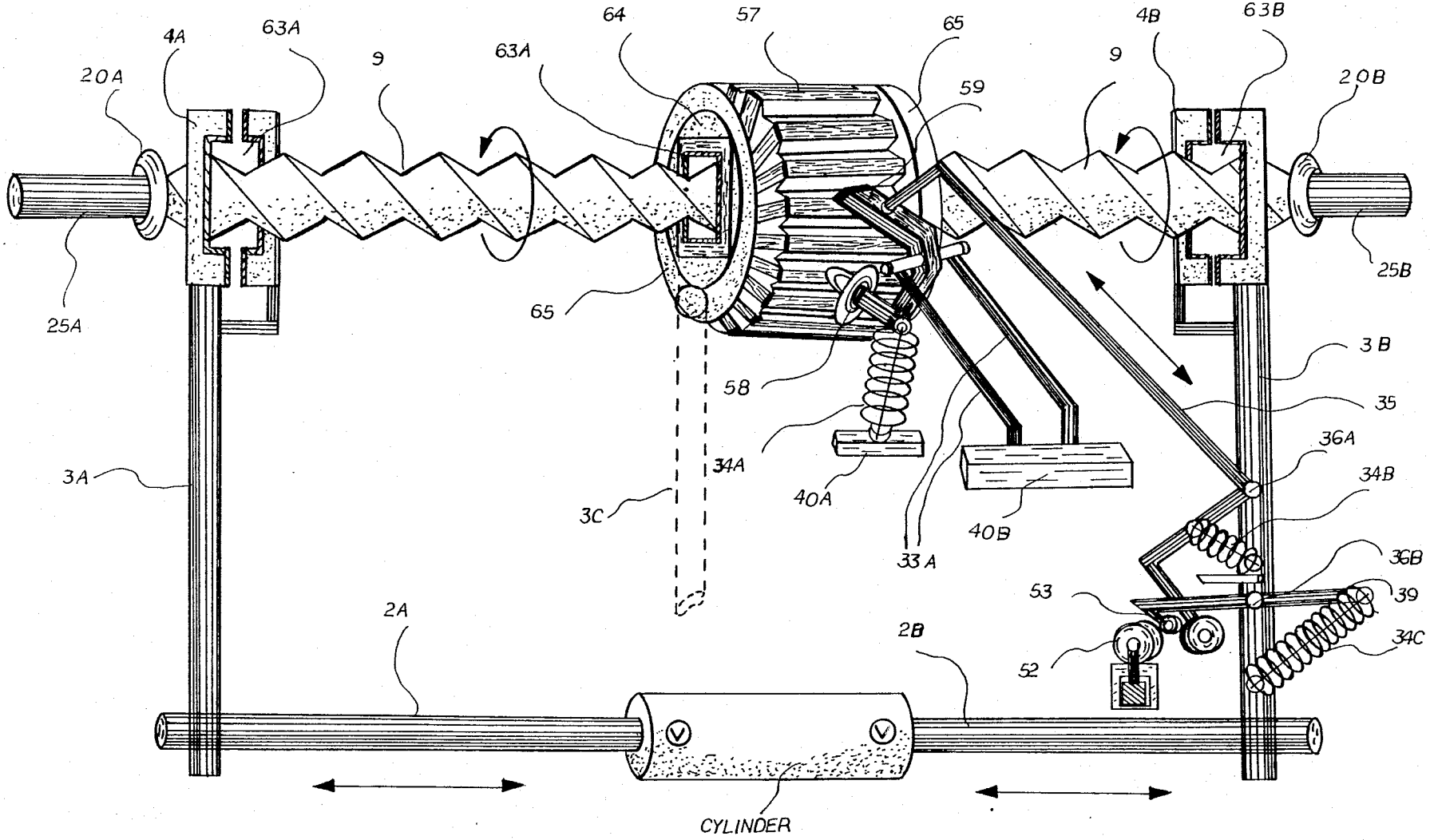
FIG. 10 is illustrative of another method for selectively engaging and disengaging the rectangular gear to the screw gear, and in this embodiment a rotatable rachet gear having the drive plate and rectangular gear to each side, both freely rotatable to bearings fixed to a hollow shaft through which the screw gear can freely rotate, the rachet gear being operatively connected to a rachet for selective engagement/disengagement means levers connected to a control arm and reciprocatable piston rod.

Because the screw engine is positive drive, it is necessary for the drive plate to be disengageable to the screw gear. Several methods are shown in the drawings, and as previously explained. A very simple method is shown in FIG. 5 and FIG. 10 in which the drive plates 4A and 4B are arranged for the metal plate forming the rectangular gear 63A and 63B to have two separate sections with each section fixed to a hinge 30A and 30B, the hinge being connected to the main drive plate 4A and 4B. During a pull operation by piston rod 2 to cylinder 1, the control arm that is connected by a locking nut 31 drives the one plate, as shown 4B, for disengagement to the screw gear 9B (shown in FIG. 5) and in FIG. 10, drive plate 4A is shown open with 4B closed. However, as shown in FIG. 5, 9B and 9A each have a separate screw pitch and only one direction of screw pitch is engageable, so the arrangement must be for the drive plate to work to the screw gear. As shown in FIG. 5, drive plate 4B is open when the piston rod 2 is in the push mode, whereas drive plate 4A is closed causing engagement to and rotation to the screw gear 9A, whereas 9B would rotate only from its gear or pulley connection as shown in FIG. 1 and FIG. 2. But in FIG. 1 and in FIG. 2 the screw gears have multiple pitch, in that the screw pitch to the one end is different from the other end and each screw gear is differently arranged to the other so that, unlike the example shown in FIG. 5 where the screw pitch is the same for the entire length of the screw, both screws can be arranged to rotate simultaneously, and this arrangement, FIG. 1 and FIG. 2, also permits bearings 20J, 20K, and FIG. 2, 20E and 20F with mounts 15A and 15B to be adapted to the center of the screw gear 9A, 9B, 9C and 9D that gives more support and strength to the operative elements.

Another mechanical method for selectively engaging and disengaging the drive elements to the screw gear is shown in drawing for FIG. 10, wherein a rachet gear 57 mounted to a hollow shaft 64 that rides to an outer bearing and race 65 being connected to a control arm 3C that is connectable to either piston rod 2A or 2B connected to a cylinder. Connected to the shaft 64 and rachet gear 57, at both ends thereof, is a rectangular or square gear 63A (63B not shown). A rachet 59, when raised, serves as a position lock to the freely rotatable rachet gear 57 and rectangular gear 63A, caused by the racket arm 58 making engagement to the teeth of the rachet gear 57 during a push movement of the piston rod 2A or 2B when the cylinder is loaded, as the rachet arm swings freely to the swivel and levers 33A connected to a stationary mount 40. In this illustration control arm 3C, that is connected to the outer race of the bearing 65 and to a piston rod, would have a crank arm 35 connected thereto means a pivot bolt for free movement thereto, the one end of the crank arm 35 connected to the rachet 59 and the other end connected to a spring 34B and having a cam adapted thereto that is operatively arranged for engagement/disengagement to a pressure trip mechanism 52 that is in a fixed position in relation to the piston rod 2A or 2B so that selective contact is made to the moving crank arm 35 and control arm 3C causing a locking lever 39 to engage and hold the crank arm 35 through a spring action 34C and 34B and the pivot bolt 36B that holds the locking lever 39 to the cam arm 3C. Normally, during a pull operation of the piston rod 2A or 2B, the spring 34A that is connected to the rachet arm 58 and that is connected at its other end to a stationary mount 40A, the rachet arm 58 will be pulled away from the rachet gear 57 by the spring 34A action caused by its tension, thus allowing the rachet 57 and rectangular gears 63A and 63B to rotate freely to the screw gear 9 without making engagement.

As it requires a great amount of energy to drive a vehicle over long distances at high speed, without requiring the vehicle to be stopped at intervals for the recharging of batteries, it is necessary that a constant supply of energy in the form of electricity or pressurized fluid be provided from the operational mechanics of the vehicle itself. This provision is made with this invention so that it is highly self sustaining in supplying energy, particularly in the form of electricity, that would maintain a constant charge to batteries needed for operating the FIG. 7 electric motor 70 for driving a pump 73 for pressuring fluid that is fed to a cylinder, FIG. 1 and FIG. 2 for driving drive plates 4A, 4B, 4C and 4D reciprocatably for rotating a series of screw gears 9A, 9B, 9C and 9D that rotate a series of pulleys and belts 28A, 28B, 28C and 28D for driving variable pulleys 19A and 19B in rotating the axles 17A and 17B to the wheels of a vehicle. And in FIG. 2 it is shown an arrangement of rotatable gears in lieu of pulleys.

However, as shown in FIG. 1, electricity is generated by alternators 5A and 5B that are driven by the axles 17A and 17B of the vehicle during braking and deceleration. Also, in FIG. 2 it is shown that electricity is constantly generated during operation of the screw engine by having conneectable gears 23A to the output shaft 25B of screw gear 9A and 9B and to gear 23B to the rotor shaft 8C for driving alternator 5B. Additionally, drive plate 4D and 4C are connected to rotate screw gear 9E and 9F that serve as the rotor shaft to alternator 15C for generating electricity when screw gear 9C and 9D is rotated during operation of the screw engine.

Figure 6:
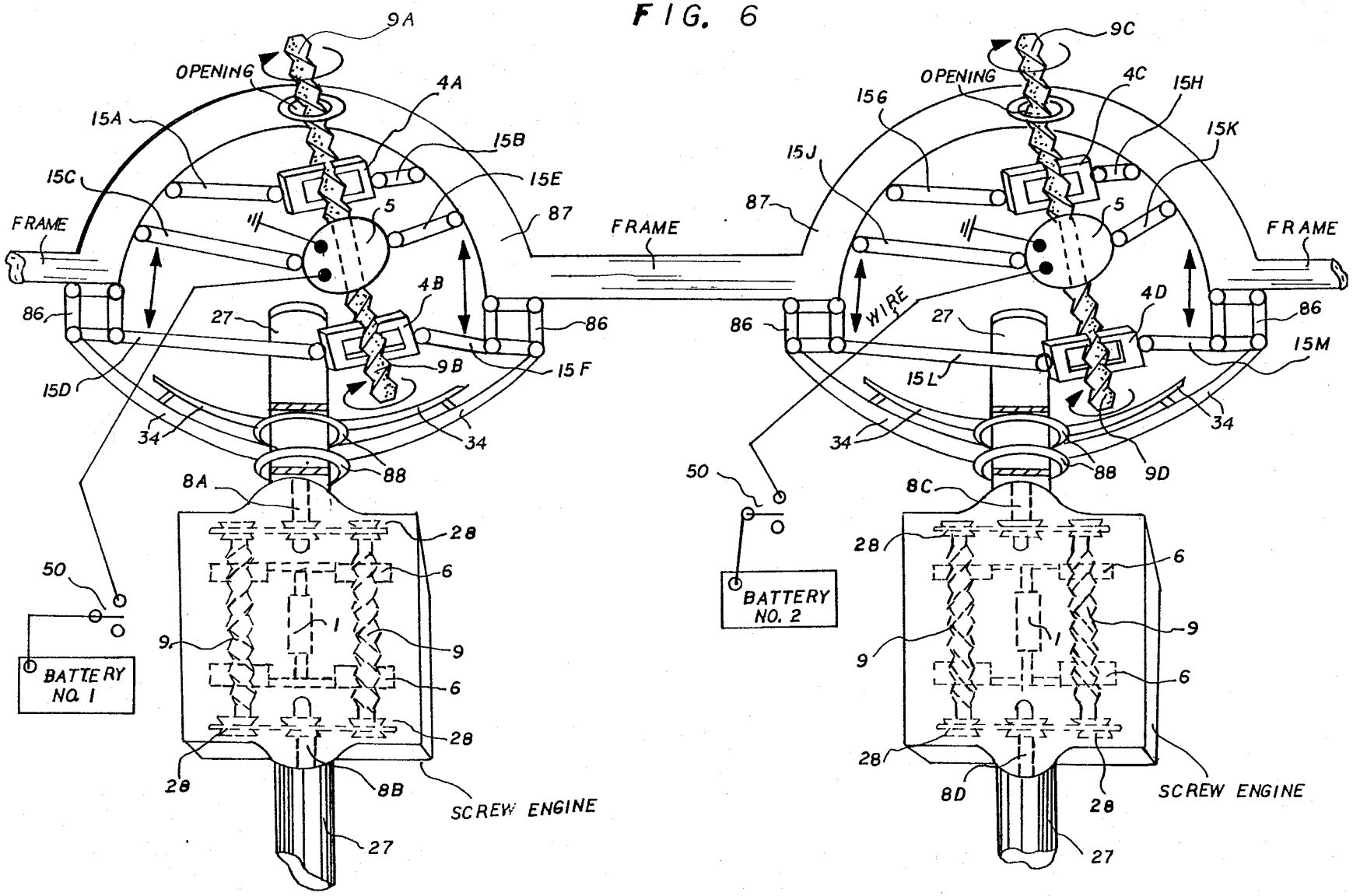
FIG. 6 is illustrative of the arrangement for having a satellite alternator connected to a multiple screw gear arrangement with the rectangular gears adapted to the chassis/frame and the axles of a vehicle in which the gravitation forces during vehicular movement cause the alternator to generate electricity that is stored in batteries.

FIG. 6, in this drawing there is disclosed a method for generating electricity by having a series of gravitational generators 5 comprising an alternator 5 having a rotor shaft at each end that is a screw gear 9A and 9B and 9C and 9D with a different angle of pitch, with each screw gear 9A, 9B, 9C and 9D driven by the reciprocatable movement of a drive plate 4A, 4B, 4C and 4D, (as previously described in Drawings for FIG. 5 and FIG. 10) with drive plate 4A and 4C connected to the wheel well 87 of a vehicle means stationary mounts 15A, 15B, 15G and 15H. The alternator 5 is fixed to the wheel well 87 of the vehicle that is connected to the frame by stationary mounts 15C, 15E, 15J and 15K, whereas drive plates 4B and 4D are connected at one end at the axle housing 27 of the vehicle and the other end to spring shackles 15D, 15F 15L and 15M and 86 for free movement to the gravitational movement of the vehicle while in motion. FIG. 6 shows just one side of a vehicle and frame and shows the axle housing 27 clamped 88 to the axle leaf springs 34 and the electrohydraulic air screw engine as shown in FIG. 1 and FIG. 2 with casing connecting the axle housing 27. As the screw gears 9A and 9C would have a vertical movement to the vehicle chassis, an opening in the wheel well 87 is provided for free movement thereof.

FIG. 6, having a very tight multiple screw pitch to the screw gears 9A, 9B, 9C and 9D provides not only high speed operation to the rotor shaft to the alternators 5 but also provides for a shock absorbing action to the vehicular movement. Generated electricity is fed through wires to storage battery No. 1 and No. 2 and for the installation of four alternators to the wheel well area of a vehicle the same arrangement would be made. A series of voltage regulators 50 adaptable to 90–100 ampere alternators that could be of the standard type as used in standard vehicles and arranged in series for the required voltage output to the battery.

Depending upon the driving conditions, and as explained fully in U.S. patent application Ser. No. 06/850,996, the electricity generated at the wheel wells 87 could average 30 amperes per wheel or higher, depending upon the terrain.

Figure 11:
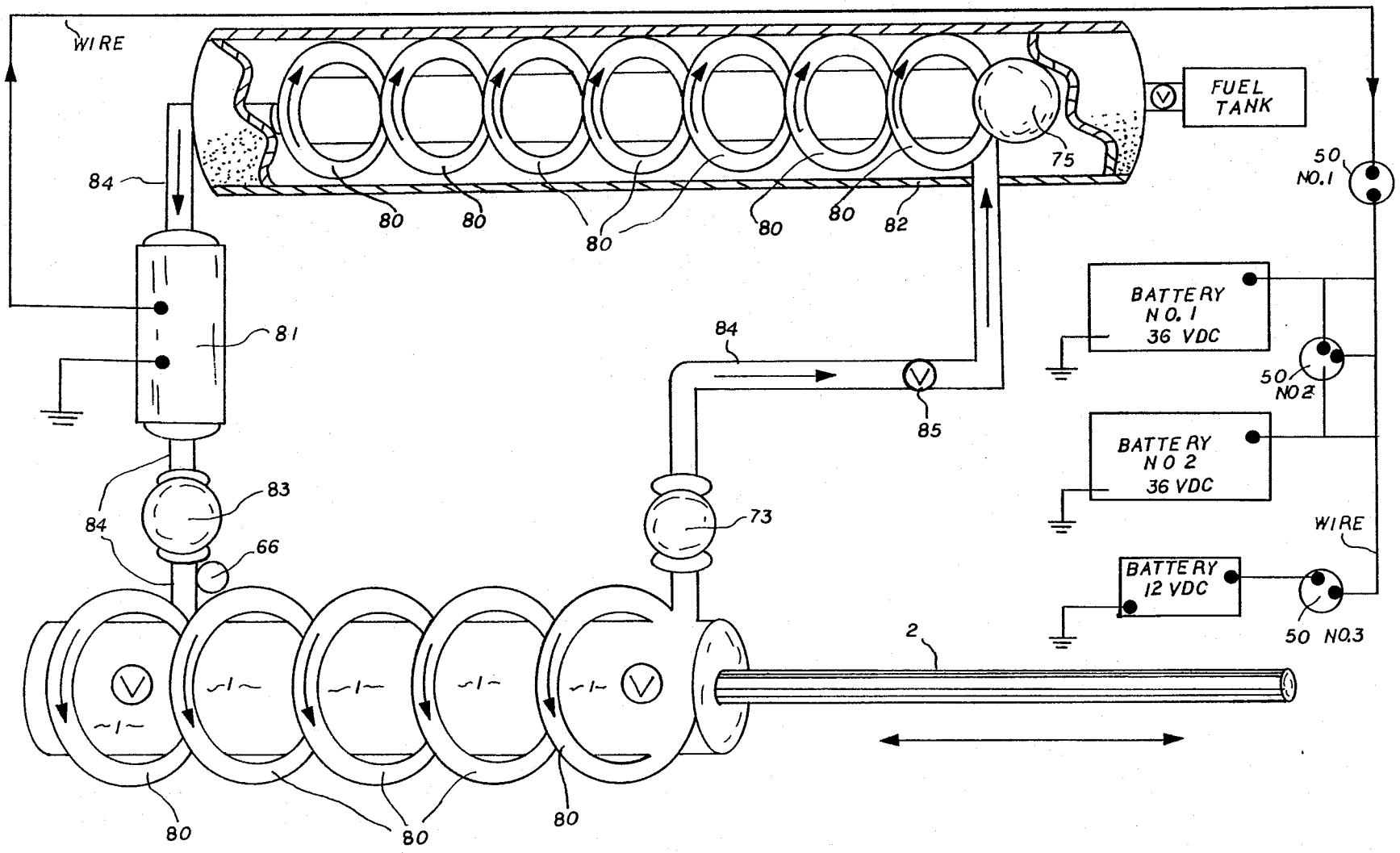
FIG. 11 is a drawing of a steam generator in which cooling coils adapted to the outside of either an air or hydraulic cylinder that drives the screw engine provides heat for operating a steam cylinder screw engine generator for generating electricity that is fed to a series of batteries for storage.

Additional kinetic energy recovery is effected by the application of a steam generator, as shown in FIG. 11, in which cooling coils 80 filled with a liquid coolant is wrapped around the air or hydraulic cylinder 1, as considerable heat is generated during its operation a method for cooling it and at the same time applying the collectible heat for driving a steam cylinder screw engine generator 81 for generating electricity during vehicle operation of the screw engine 1. A separate steam cylinder connected to drive plates for rotating a series of rotatable screw gears (not shown) that would drive a generator for generating electricity from steam pressure supplied partially from the heat collected at the cylinder walls, then driven by a pump 73 through a pipeline 84 to a series of heating coils 80 enclosed in a boiler casing 82 and heated by a burner 75 that is controlled by an automatic pilot (not shown) and a pressure regulator valve leading from a fuel tank that would supply fuel to the burner 75 as needed. Fuel used could be preferably propane gas, that would provide a non polluting fuel and easy storage. However, any type of fuel, such as heating oil, could be used. The pressurized steam is forced through the heating coils 80 to a pipeline 84 connected to the steam cylinder 81 thereupon driving the piston therein, the discharged steam is condensed in a cooler condenser 83 and cooled by additional cooling fluid that is fed to the return line from a reserve tank 66 before entering the cooling coils 80 at the cylinder 1 that is operative to the piston rod 2 in driving the screw engine 1.

FIG. 11, electricity generated at the steam cylinder screw engine generator 81 is fed through a wire to voltage regulator No. 1 that controls the output voltage to Battery pack No. 1, Battery Pack No. 2 that are either 36 VDC or 72 VDC, and provide power for driving an electric motor connected to a pump for pressurizing working fluid for operating the screw engine. Electricity is also fed to a 12 VDC battery for providing electricity for operating the lighting system to a vehicle and other accessories including an air conditioner that could be operative to the screw engine.

FIG. 11, positioned between battery pack number 1 and battery pack number 2 is a voltage regulator 50 for regulating the voltage fed from battery pack number 1 to battery pack number 2, that is the battery and energy source for driving the electrohydraulic/air screw engine 1 and would provide energy for driving the electric motor as explained previously. Electricity at regulator number 1, that is prefixed and predetermined voltage for the first battery, when it is fully charged the electricity is bypassed to the second and drive battery pack number 2 and alternately can charge both batteries number 1 and number 2 and also the 12 VDC battery source through regulator number 3. As this screw engine arrangement can be light weight and reduce considerably the weight to a standard vehicle after the engine, transmission and differential are removed, it can be applied to conversion of any standard vehicle, more than one battery pack can be added to the weight pack of the payload to the vehicle without adding to the previous payload.

FIG. 11, the pressure valve 8 in the pipeline 84 between the cylinder and the burner 75 is electrically connected to the pressure regulator valve and pilot valve between the fuel tank and the burner 75 and is the control valve for turning on and off the fuel from the fuel tank when the pressure in the pipeline 84 from the pump 73 reaches a predetermined and preset level, as hydraulic and air cylinders can generate considerable heat during operation and most cylinders can withstand 200–300 degrees fahrenheit, so considerable heat is dissipated with this system whereby the fuel tank and burner 75 would not be in constant operation but would be intermittent when the pressure in the line would drop below a predetermined level. Also operator controls 49 are provided, as shown in FIG. 7, for controlling the electrical circuitry, and the electric valves are wired to the central master control switch 62 besides the electric solenoid valves 85 to the burner 75. Also, connected to the wiring arrangement, (not shown) is a charging level switch at the battery packs no. 1 and no. 2 that would switch on the steam generator 81 for feeding fuel and ignition at the burner 75 through the master control switch 62 when the charge level in the batteries mentioned above would reach a predetermined level and need charging. This could be done during standby when the vehicle would be inoperational, and could be arranged for automatic operation or manual control by the vehicle operator. FIG. 1, a clutch mechanism 6A, 6B, 6C and 6D, that can be either electric or manual, engages or disengages the pulley belts 26.

The invention claimed is:

1. A battery operated hydraulic/air driven screw engine providing power for driving a wheeled vehicle, including means for the recovery of kinetic energy, wherein said improvement comprises:

(a) a vehicle having wheels and rotatable axles;

(b) a screw engine comprising a fluid cylinder arranged for reciprocatably driving a gear element arranged in circumference to and for imparting rotary motion to a worm screw gear having an output shaft operably connected for driving the axles of a vehicle;

(c) means for operatively connecting said screw engine between said wheels of said vehicle and driving said wheels of said vehicle;

(d) means for operatively connecting said screw engine between two separate differentials and axles of a vehicle providing selective four wheel drive to said vehicle;

(e) means for the recovery of kinetic energy including:

the selective adaptation of a series of gravitational screw generators operably positioned between the chassis/frame and axle element of a vehicle for generating electricity during vehicular movement;

means for providing cooling to and the extraction of heat from a fluid cylinder operative to said screw engine, whereby said heat is transmitted to a steam cylinder screw engine generator for generating electricity for storage;

(f) a series of gear elements comprising a rectangular or square gear operably arranged for providing rotation to a worm screw gear;

(g) a series of clutch mechanisms operably connected to the series of rectangular or square gears for providing engagement to and disengagement from the worm screw gear;

(h) a housing for containing a series of storage batteries for driving an electric motor therein that is operably connected to a pump for pressurizing working fluid providing power to said fluid cylinder therein and operatively connected means geared element to said worm screw gear therein, a portion of said axles adapted to the inside of said housing for operative connection to said worm screw gear shaft;

(i) said housing having an output shaft at each end that is operably connected to said worm screw gear shaft inside said housing and said output shaft operably connected to a universal joint outside said housing.

2. The invention according to claim 1 wherein said screw engine comprises:

at least one fluid cylinder;

said fluid cylinder having at least one reciprocatably piston and rod and a series of input and output ports;

each said input and output port to said fluid cylinder provided with either electric or manual valves for controlling the input and the output of working fluid at said fluid cylinder;

a operable connecting element from said piston rod for reciprocatably driving a rectangular or square gear comprising a selective opening to said element proportionately sized internally and circumferentially for making engageable contact to and for rotatably driving said worm screw gear;

said worm screw gear mounted to at least two bearings for free movement thereto and having an output shaft at each end for driving a rotatable pulley or gear element;

said pulley or gear element operatively connected to said axles to said vehicle and arranged for selective engagement/disengagement to said axles and to said output shaft of said worm screw gear;

said pulley or said gear element operativley connected to said output shaft to said housing and arranged for selective engagement/disengagement to said output shaft and to said output shaft to said worm screw gear.

3. The invention according to claim 1 including means for the recovery of kinetic energy:

an alternator/generator operably connected between the axle and chassis/frame members of a vehicle, said alternator/generator having a rotor shaft extending from both ends that comprise a right hand screw pitch to the one shaft end and a left hand screw pitch to the other shaft end, and each said screw shaft having operatively and circumferentially adapted thereto a proportionately sized rectangular or square opening for reciprocatably making contact to said worm screw gear imparting a rotation to said worm screw gear and to said rotor thereby generting electricity during vehicular movement;

a series of cooling coils containing a liquid coolant adapted at said fluid cylinder to said screw engine for cooling and extracting heat from said fluid cylinder during its operation, that is fed to a boiler for the reheating of said liquid for transmission to a second and steam cylinder operatively connected to a screw gear generator (as described in the above paragraph) for generating electricity for storage.

4. The invention according to claim 1 wherein electricity is generated during operation of said screw engine:

at least one alternator operatively connected to said output shaft of said worm screw gear for driving said alternator in generating electricity;

at least one alternator having a stator and a rotor serving as the input shaft, whereby said rotor extends to both sides of said alternator in the form of a screw gear having a right hand pitch to one side and left hand pitch to the other side of said alternator, with a rectangular or square gear operatively connecting the outer circumference to said screw gear and operably connected to said fluid cylinder to said screw engine for reciprocatably driving said rectangular or square gear during operation of said screw engine and thereby providing a rotational force to said rotor to said alternator in generating electricity.

5. The invention according to claim 1 whereby selective engagement/disengagement to said rectangular or square drive gear for rotating said worm screw gear and shaft, wherein:

means for expanding the opening to said reciprocatable rectangular or square gear for not making contact to said worm screw gear and means for closing said reciprocatable rectangular or square gear for making engageable contact for rotating said worm screw gear;

said rectangular or square gear comprising a plate with a proportionately sized opening therein for making positive engagement to said worm screw gear when reciprocated, the plate comprising two separate adjustable plates overlapping the base plate having a larger than necessary rectangular or square opening, with the adjustable plates being freely movable to a series of slots and bolts to the base plate and connected to a series of springs and levers operably connected to a reciprocatable piston rod and to a disassociated cam at a stationary mount serving as a trip reciprocatable movement of the piston rod and in opening and closing the adjustable plates for either making engagement or disengagement to the worm screw gear;

a freely rotatable rachet gear adapted to a hollow bearing shaft with each end of said hollow shaft having fixed thereto a plate having a fixed rectangular or square opening to its center serving as a gear that is in constant engagement to a worm screw gear, adapted to a swivel and in working relationship to the rachet gear is a locking rachet for locking the rachet gear and in engagement to the rectangular or square gear according to the reciprocatable movement of a piston rod to a connecting lever and locking cam positioned stationary to the piston rod, thus causing the rachet gear and rectangular or square gear to rotate freely to the worm screw gear or to provide positive drive to it;

the rectangular or square gear being separated into two equal parts and mounted to a base plate means a hinge for the automatic opening or closing of said gear depending upon which direction it is reciprocated to the worm screw gear and its angle of pitch;

a hollow shaft fixed to a control arm connected to a reciprocatable piston rod and having a clutch mechanism fixed thereto and a throwout bearing, a fixed in size rectangular or square gear connected to an overriding shaft and control arm connected to said piston rod and to a lever and spring in working relationship to a stationary trip mechanism for reciprocatably and slidably engaging said rectangular or square gear to said fixed hollow shaft and clutch mechanism or for slidable engagement to said throwout bearing for free rotation of said rectangular or square gear to said worm screw gear;

a drive plate comprising two separate sections, an outer and an inner section, both in working relationship and interconnected circumferentially by a series of freely rotatable bearings, with each section magnetically connected to a series of electromagnets, the outer section connected to a reciprocatable piston and rod and the inner section containing to its center thereof a rectangular or square gear opening circumferentially proportionate to and operably slidable to a worm screw gear for providing rotation thereto, with engagement/disengagement between the two sections provided by electrical switching to said electromagnets according to the reciprocatable movement of said loaded piston and rod providing selective clutch action between the two sections of the drive plate;

a series of freely rotatable bearings arranged for forming a rectangular or square opening circumferentially proportionate to and slidably rotatable for providing rotation to a worm screw gear, with each bearing operably connected to a slidable mount with each mount operably arranged to a spring loaded control arm adapted to a swivel connected to a reciprocatable piston and rod and to a rotatable bearing arranged for reciprocatable slidable movement to a guide rail for loading and unloading said spring loaded control arm and for providing selective engagement of said bearings to said worm screw gear for providing rotation thereof during a push movement of said piston and rod and disengagement of said bearings to said worm screw gear during a pull movement of said piston and rod or vice versa.

* * * * *